US007118424B2

(12) United States Patent
Masaki et al.

(10) Patent No.: US 7,118,424 B2
(45) Date of Patent: Oct. 10, 2006

(54) ELECTRICAL CONNECTOR

(75) Inventors: Katsuyuki Masaki, Kanagawa (JP); Shinichi Kodama, Kanagawa (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/261,508

(22) Filed: Oct. 31, 2005

(65) Prior Publication Data

US 2006/0094304 A1 May 4, 2006

(30) Foreign Application Priority Data

Nov. 1, 2004 (JP) ..... 2004-317951

(51) Int. Cl.
*H01R 13/10* (2006.01)

(52) U.S. Cl. ..... 439/682

(58) Field of Classification Search ..... 439/682, 439/857, 850

See application file for complete search history.

(56) References Cited

U.S. PATENT DOCUMENTS

| | | | | |
|---|---|---|---|---|
| 5,788,539 | A * | 8/1998 | Fedder | 439/682 |
| 5,951,331 | A * | 9/1999 | Li-Ming et al. | 439/682 |
| 6,039,610 | A * | 3/2000 | Pauza et al. | 439/682 |
| 6,443,779 | B1 * | 9/2002 | Suzuki | 439/701 |
| 6,506,081 | B1 * | 1/2003 | Blanchfield et al. | 439/682 |
| 6,551,143 | B1 * | 4/2003 | Tanaka et al. | 439/682 |
| 6,739,893 | B1 * | 5/2004 | Hallitschke et al. | 439/248 |
| 6,848,950 | B1 * | 2/2005 | Allison et al. | 439/682 |
| 6,930,248 | B1 * | 8/2005 | Saka et al. | 174/50 |
| 2001/0021609 | A1 * | 9/2001 | Chiang | 439/682 |
| 2004/0002265 | A1 * | 1/2004 | Shimizu et al. | 439/660 |
| 2005/0186855 | A1 * | 8/2005 | Shimizu et al. | 439/682 |

FOREIGN PATENT DOCUMENTS

| | | | |
|---|---|---|---|
| JP | 2514762 | Y | 8/1996 |
| JP | 2002-033150 | A | 1/2002 |
| JP | 2003-059580 | A | 2/2003 |
| JP | 2003-161864 | A | 6/2003 |
| JP | 2004-533008 | A | 10/2004 |

* cited by examiner

*Primary Examiner*—Tulsidas C. Patel
*Assistant Examiner*—Vladimir Imas
(74) *Attorney, Agent, or Firm*—Rader, Fishman & Grauer PLLC

(57) ABSTRACT

An electrical connector comprises: a base connector having a base housing and fixed to a print board, the base housing defining a recess having a plurality of plane opponent contacts; a socket connector having a socket housing that houses a plurality of socket contacts to be connected with the opponent contacts, the socket connector inserted into and removed from the recess; a plurality of lead wires extending in a direction substantially parallel to an attachment face of the print board; a pair of first locking mechanisms provided with the base housing and the socket housing, respectively, the first locking mechanisms engaging each other in a direction perpendicular to the direction of extension of the lead wires; and a pair of second locking mechanisms provided with the base housing and the socket housing, respectively, the second locking mechanisms engaging each other in a direction opposite the direction of extension of the lead wires.

5 Claims, 11 Drawing Sheets

ELECTRICAL CONNECTOR

BACKGROUND OF THE INVENTION

1. Field of the Invention

Priority is claimed on Japanese Patent Application No. 2004-317951, filed Nov. 1, 2004, the content of which is incorporated herein by reference.

The present invention relates to an electrical connector. In particular, the invention relates to an electrical connector having a locking mechanism for maintaining engagement between two connectors, one of which is a base connector fixed to a print board and the other of which is a socket connector inserted into and removed from the base connector.

2. Description of the Related Art

Nowadays, a compact-sized portable electronic device such as DSC (Digital Still Camera), cellular phone, CD player, or MD player incorporates a battery. To supply electric power from the battery to a circuit board (print board) installed in said electronic device, an extremely small connector, so called CSP (Chip Size Package) type wire to board connector, has been employed.

An electrical connector has been invented in which one ends of lead wires extending from the battery are attached to a socket connector like the above-mentioned socket connector and a base connector like the above-mentioned base connector is fixed to a print board. Further, this electrical connector is designed to avoid a problematic situation where the insertion/removal directions of the socket connector and the direction of extension of the lead wires are different when the lead wires are pulled away to remove the socket connector from the base connector, thereby causing the connectors to tend to be broken by prying damage on these connectors (e.g., refer to Patent document 1).

In the electrical connector according to Patent document 1, when the lead wires are pulled away, the cam face of the base connector and the cam face of the socket connector act together to convert the pulling force to a force along the insertion/removal directions of the socket connector. Further, in the electrical connector, the socket connector is provided with socket contacts for applying a contact force in such a manner that a pair of contact strips on the socket contact sandwich a plane opponent contact from both sides of the opponent contact.

[Patent Document 1]

Japanese Unexamined Patent Publication 2002-33150

FIG. 17 is a general perspective view of the base connector according to Patent document 1. Further, FIG. 17 of this application corresponds to FIG. 1 of Patent document 1. FIG. 18 is a general perspective view of the socket connector according to Patent document 1. Further, FIG. 18 of this application corresponds to FIG. 2 of Patent document 1. Moreover, FIG. 19 is a vertical cross-sectional view of both connectors in a mated condition in Patent document 1. In FIG. 19, hatching of the socket contact and plane connection terminals is omitted. Further, FIG. 19 of this application corresponds to FIG. 9 of Patent document 1. FIG. 20 is a front view of the socket connector according to Patent document 1. Further, FIG. 20 of this application corresponds to FIG. 8 of Patent document 1.

A conventional electrical connector (hereinafter, referred to simply as connector) 100 comprises a base connector 6 solder-bonded to an attachment face 51 of a print board 5 and a socket connector 7 forming a pair with the base connector 6 and inserted into/removed from a recess (space for insertion/removal) 61 of the base connector 6.

In FIG. 17 and FIG. 18, the recess 61 of the base connector 6 is open in a direction perpendicular to an attachment face 51 of the print board 5 and away from the attachment face 51 (corresponding to the removal direction X2 of FIG. 17), and is also open in one out of two opposite directions parallel to the attachment face 51, i.e., in a front direction Y. The socket connector 7 is inserted into and removed from the recess 61 of the base connector 6 in an insertion direction X1 and a removal direction X2 perpendicular to the attachment face 51. The socket connector 7 is provided with lead wires 9*w* as an electrical conductor extending generally in the front direction Y.

When the socket connector 7 is removed from the base connector 6, the lead wires 9*w* are in some cases pulled in a direction other than the removal direction X2. If the wires are pulled in that direction, a pulling force via the lead wires 9*w* is converted to a force in the removal direction X2 of the socket connector 7 in order to smoothly remove the socket connector 7 without having to pry off the connectors.

In FIG. 17, the base connector 6 is provided with a base housing 60 comprising a base 62 fixed along the attachment face 51, a pair of sidewalls 62*a*, 62*b* disposed in upright position on left/right sides of the base 62, and a rear wall 62*c*. The base 62, the pair of sidewalls 62*a*, 62*b*, and the rear wall 62*c* are combined to form the recess 61.

In FIG. 17, the recess 61 houses a plurality of (e. g., three) plane contacts 8 (hereinafter, referred to as plane connection terminals 8) parallel to the sidewalls 62*a*, 62*b*. In FIG. 19, the plane connection terminals 8 are inserted into fixing holes formed in the base 62 and held by the base 62 and the rear wall 62*c*. The plane connection terminal 8 includes a substantially rectangular main body 80 and a lead portion 8*r* extending from the lower end to rear side of the main body 80. The main body 80 has a contact portion 81 protruding into the recess 61 (refer to FIG. 19).

When both connectors 6, 7 are in a mated condition, the plane connection terminal 8 is sandwiched by a pair of contact strips 91*a*, 91*b* included in the socket contact 9 of the socket connector 7 from both sides of the terminal and held by the strips (refer to FIG. 20).

In FIG. 17, the rear wall 62*c* is provided with a pair of vertical grooves 64*a*, 64*b* along the pair of the sidewalls 62*a*, 62*b*. When both connectors 6, 7 are in a mated condition, the pair of vertical grooves 64*a*, 64*b* act as seats for a pair of vertical ribs, not shown, formed in the socket connector 7.

In FIG. 17, a pair of mating grooves 63*a*, 63*b* extending from the bottom to top of the recess 61 are provided in the inner faces of the pair of sidewalls 62*a*, 62*b*. The pair of mating grooves 63*a*, 63*b* act as seats for a pair of two-step ribs 73*a*, 73*b* formed on and protruding from both sides of the socket connector 7 (refer to FIG. 18). The pair of two-step ribs 73*a*, 73*b* include thick upper ribs 73*a*1, 73*b*1 and thin lower ribs 73*a*2, 73*b*2.

In FIG. 18, the pair of lower ribs 73*a*2, 73*b*2 are of a triangular shape and have a width gradually reduced from the top to bottom of the rib, and the inclined faces of the ribs form cam faces for slidable engagement with inclined faces (refer to FIG. 17) formed on the pair of mating grooves 63*a*, 63*b*. This allows conversion of a pulling force causing the socket connector 7 with the lead wires 9*w* to be pulled in the front direction Y into a force in the removal direction X1 of the socket connector 7.

In FIG. 17, a pair of mating projections 66*a*, 66*b* facing each other are provided on the upper front portions of the inner faces of the pair of sidewalls 62*a*, 62*b*. When both connectors 6, 7 are in a mated condition, the pair of mating projections 66*a*, 66*b* mate with a pair of mating depressions 76*a*, 76*b* (refer to FIG. 18) provided on both side faces 72*a*, 72*b* of a socket housing 70, thereby allowing both connectors 6, 7 in a mated condition to be held with a predetermined holding force. Further, the pair of mating projections 66*a*, 66*b* and the pair of mating depressions 66*a*, 66*b* form a locking mechanism.

Note that in FIG. 17, a pair of reinforcing tabs 67*a*, 67*b* as a metallic reinforcing member are pressed into press-fit grooves formed in the lower front portions of the base housing 60 and a part of the reinforcing tab is exposed from the corresponding side face of the base housing 60 so as to be solder-bonded to the attachment face 51 of the print board 5.

In FIG. 18, the socket connector 7 comprises in its front section a projection 72*c* provided on the upper face, i.e., a pressing face of the socket housing 70 and protruding so as to correspond to the position of the socket contact 9, and the above-described pair of two-step ribs 73*a*, 73*b* formed on and protruding from both side faces of the socket housing 70, respectively. Pressing the surface of the projection 72*c* allows the socket connector 7 to be mounted onto the base connector 6.

In FIG. 19, the base housing 60 of the base connector 6 is provided with the plane connection terminals 8. On the other hand, the socket housing 70 of the socket connector 7 is provided with the socket contacts 9. For example, the base housing 60 is provided with three plane connection terminals 8 disposed in parallel to one another and the corresponding three socket contacts 9 are disposed in parallel in the socket housing 70. The lead wires 9*w* press-bonded to pressing portions 92 of the socket contacts 9 extend from the socket housing 70.

In FIG. 19, the plane connection terminal 8 comprises the main body 80 pressed into the base housing 60 and fixed thereto, and the contact portion 81 protruding into the recess 61 formed in the base connector 6. On the other hand, the socket contact 9 is inserted into and held by a compartment 71 having the shape of a square pole. A portion of the compartment 71 corresponding to the contact portion 91 of the socket contact 9 is opened toward the recess 61.

In FIG. 19, the socket connector 7 is inserted toward the recess 61 formed in the base connector 6 and mates with the base connector 6. Then, the plane connection terminal 8 and the socket contact 9 forming a pair are electrically connected.

In FIG. 20, the socket contact 9 has a pair of contact strips 91*a*, 91*b* extending in parallel and facing each other, and the contact strips are provided with contact points 91*c*, 91*d* made of projections protruding so as to face the corresponding opposing face of the corresponding one of the pair of contact strips 91*a*, 91*b*.

In FIG. 20, the contact portion 81 (refer to FIG. 19) of the plane connection terminal 8 of the base connector 6 is inserted into a gap S between the pair of opposing contact points 91*c*, 91*d* and the plane connection terminal 8 is sandwiched and elastically held by the pair of contact strips 91*a*, 91*b*, thereby allowing for intimate contact between the plane connection terminal 8 and the socket contact 9.

However, it has been required that the socket connector 7 shown in FIG. 18 is mounted at a substantially lower height. Further, the mounting height of the socket connector 7 is substantially determined by the distance over which the pair of contact strips 91*a*, 91*b* provided in the socket contact 9 extend. It has been required that the structure of the socket contact is changed in order for the socket connector to be mounted at a substantially lower height.

In order to solve the aforementioned problems, the structure of the socket contact is changed to allow the socket connector to be mounted at a substantially lower height and further the base contact to be mounted at a substantially lower height. In this case, it becomes impossible to allow the recess provided in the base connector to have a sufficient depth. Further, when such connectors having a lower height are used, it would be undesirable and expected that the lead wires extending from the socket connector act to cause the movement of the socket connector about a point of support, which movement is associated with a pair of locking mechanisms installed at both sides of the socket connector. This implies that the movement of the socket connector eventually leads to contact failure.

Therefore, there is a need for a more reliable electrical connecter having a locking mechanism for securely maintaining engagement between both the extremely small connectors having a lowered height, one of which is a base connector fixed to a print board and the other of which is a socket connector inserted into/removed from the base connector and having lead wires. Thus, it can be concluded that the foregoing is the subject of the invention.

In consideration of the above-mentioned problems, an object of the invention is to provide a compact sized electrical connector having a low height and equipped with a locking mechanism for securely maintaining engagement between both connectors, one of which is a socket connector inserted into a recess formed in a base connector, without being affected by lead wires extending from the socket connector.

SUMMARY OF THE INVENTION

In order to achieve the above-described object, the inventors have invented a new electrical connector, which is configured so that a pair of first locking mechanisms are installed in opposing walls forming a recess of a base connector and a pair of outer walls of a socket connector facing the opposing walls, and a second locking mechanism is installed in an inner wall forming a depression opposite the direction of extension of lead wires and an outer wall of the socket connector facing the inner wall, and the electrical connector further has the following features.

(1) The electrical connector comprises: an approximately rectangular parallelepiped shaped base connector having a base housing and fixed to a print board, the base housing defining a recess having a plurality of plane opponent contacts arranged therein; and an approximately rectangular parallelepiped shaped socket connector having a socket housing that houses a plurality of socket contacts connected so as to mate with the opponent contacts, the socket connector inserted into and removed from the recess of the base housing in insertion and removal directions substantially perpendicular to an attachment face of the print board, in which the socket connector has a plurality of lead wires extending in a direction substantially parallel to the attachment face in a situation where the base connector is inserted into the socket connector, a pair of first locking mechanisms for effecting engagement between two objects, both of which are keyed to mate in a direction perpendicular to the direction of extension of the lead wires, are installed in a pair of first inner walls facing each other in the recess of the base housing and a pair of first outer walls formed in opposite positions of the socket housing, and one or more second locking mechanisms for effecting engagement between two objects are installed in a second inner wall formed in the recess of the base housing in a direction opposite the direction of extension of the lead wires and a second outer wall formed in the socket housing in a direction opposite the direction of extension of the lead wires.

The electrical connector according to the invention (1) comprises the approximately rectangular parallelepiped shaped base connector having the base housing and fixed to the print board, the base housing defining the recess having a plurality of plane opponent contacts arranged therein. This base connector could be a connector that is connected to a socket connector inserted into the recess of the base housing and the base housing is an insulator. For example, the recess has on its one side an opening for allowing a plurality of lead wires to extend from the opening and is formed in the shape of a thin rectangular parallelepiped with three sides defined by a pair of sidewalls and a sidewall facing the opening.

The statement "a plurality of plane opponent contacts are arranged in the recess" is applicable, for example, in a situation where a part of the opponent contact protrudes into the recess and the part protruding into the recess acts as a contact portion for mating engagement with the socket contact housed in the socket housing.

The statement "the base connector is fixed to the print board" is applicable, for example, in a situation where the base connector is fixed to the print board with screws and the like, and in a situation where the opponent contacts securely pressed into the base housing are solder-bonded and fixed to the print board, i. e., the base connector is fixed to the print board with solder, namely via surface mount technology. Incidentally, in case of surface mounting, it is contemplated that a pair of reinforcing tabs as a metallic reinforcing member are prepared and pressed into and fixed to the base housing, and the pair of reinforcing tabs, along with the opponent contacts, are solder-bonded to the attachment face of the print board, thereby fixing the base connector to the print board.

The electrical connector according to the invention (1) comprises the approximately rectangular parallelepiped shaped socket connector having the socket housing that houses a plurality of socket contacts connected so as to mate with the opponent contacts, in which the socket connector is inserted into and removed from the recess of the base connector in insertion and removal directions substantially perpendicular to an attachment face of the print board.

The socket contact housed in the socket housing may be a socket contact including a pair of elastic contact strips that extend in parallel and apply a contact force to both faces of the plane or straight tooth opponent contact, and for example, the socket contact could be a tab receptacle and an elastic contact, so called a turning fork contact, that has the shape of a turning fork and is used to apply a contact force in the opposing directions of the thickness of the contact by means of two arms. The socket contact may be a bellows style fork contact disclosed in the conventional technique and is preferably a socket contact having a structure enabling a socket connector to be lower in height and smaller in volume.

Further, in case of a connector for supplying electrical power from a battery, the socket contacts and the opponent contacts of the connector are available in a two-pole or three-pole configuration, however, the connector could be a multi-pole connector having three or more socket contacts and opponent contacts.

The statement "the socket connector is inserted into and removed from the recess of the base connector in insertion and removal directions perpendicular to the attachment face of the print board" implies that the socket connector is a so-called top-mounted connector. In addition to the top-mounted connector, there is a so-called side-mounted connector. In case of a side-mounted connector, a socket connector is inserted into and removed from a base connector in insertion and removal directions parallel to the attachment face of a print board. In a wire-to-board connector, a top-mounted connector advantageously increases the degree of freedom of arrangement of the connector on a print board. On the other hand, in case of a side-mounted connector, there is a restriction on a base connector which must be disposed at the end of a print board.

In a case where a socket connector is inserted into the recess of a base connector, the socket connector is pressed and inserted into the recess of the base connector in a direction substantially perpendicular to the recess. In this case, it could be thought that the approximately rectangular parallelepiped shaped socket connector conforms to the shape of the recess and the socket connector is, for example, embedded in the recess or inserted into the base connector so that the upper face of the socket connector and the upper face of the base connector are substantially in the same plane. When the socket connector is going to be removed from the base connector, lead wires (described later) extending from the socket connector are pulled to allow the socket connector to be removed from the base connector in a direction substantially perpendicular to the recess.

Further, the electrical connector according to the invention (1) is configured so that in a situation where the base connector is inserted into the socket connector, the socket connector has a plurality of lead wires extending in a direction substantially parallel to the attachment face. For example, the socket contact could be a press contact to which a lead wire is joined using mechanical press bonding or a pressure welding contact to which a lead wire is joined by pressure welding and the lead wires are extended from the socket contact housed in a socket housing. The terminal ends of the lead wires are connected, for example, to a battery supply incorporated in an electronic device. It is preferred that connection is made between the terminating ends of the lead wires and the ends of the lead wires connected to the socket connector so as to allow the lead wires to be pulled while leaving a predetermined distance between the "pulled" portion and both ends of the lead wires (pull length tolerance).

Further, the electrical connector according to the invention (1) is configured so that a pair of first locking mechanisms for effecting engagement between two objects, both of which are keyed to mate in a direction perpendicular to the direction of extension of the lead wires, are installed in a pair of first inner walls facing each other in the recess of the base housing and a pair of first outer walls formed in opposite positions of the socket housing.

The pair of first inner walls could be a pair of opposing inner walls formed in a pair of sidewalls defining the recess and facing each other and the pair of first outer walls could be a pair of outer walls that are caused to face the pair of first inner walls when the socket housing is inserted into the recess.

For example, it could be completed that the pair of first inner walls have formed thereon a pair of detents such as pawls, balls, bosses (projections) and the pair of first outer walls have formed therein a pair of indents (depressions or concaves) corresponding to the pair of detents, thereby allowing the pair of detents and the pair of indents to form the pair of first locking mechanisms. Instead, it could be completed that the pair of first inner walls have formed therein a pair of indents and the pair of first outer walls have formed thereon a pair of detents, thereby allowing the pair of indents and the pair of detents to form the pair of first locking mechanisms.

Further, the electrical connector according to the invention (1) is configured so that one or more second locking mechanisms for effecting engagement between two objects are installed in a second inner wall formed in the recess of the base housing in a direction opposite the direction of extension of the lead wires and a second outer wall formed in the socket housing in a direction opposite the direction of extension of the lead wires.

The second inner wall could be an inner wall formed in a sidewall provided perpendicular to the pair of sidewalls and defining the recess and the second outer wall could be an outer wall that faces the second inner wall when the socket housing is inserted into the recess.

For example, it could be completed that the second inner wall has formed thereon a detent such as pawl, ball, boss (projection) and the second outer wall has formed therein an indent (depression or concave) corresponding to the detent, thereby allowing the detent and the indent to form the second locking mechanisms. Instead, it could be completed that the second inner wall has formed therein an indent and the second outer wall has formed thereon a detent, thereby allowing the indent and the detent to form the second locking mechanisms.

The socket contact according to the invention is configured to have the pair of first locking mechanisms installed at both sides of the socket housing and further have the second locking mechanisms installed in a position opposite the direction of extension of the lead wires, thereby preventing movement of the socket contact having a lower height about a point of support, which movement is due to the movement of lead wires, associated with a pair of locking mechanisms, and observed in the conventional electrical connector. Accordingly, the electrical connector describe above allows secure engagement between the socket connector and the base connector without being affected by lead wires extending from the socket connector.

(2) The electrical connector according to the invention (1) comprises: a pair of mating depressions provided in the pair of first inner walls; and a pair of mating projections provided on the pair of first outer walls and mating with the pair of mating depressions, in which the pair of mating depressions and the pair of mating projections form the pair of first locking mechanisms.

The electrical connector according to the invention (2) comprises the pair of mating depressions provided in the pair of first inner wall. Further, the electrical connector comprises the pair of mating projections provided on the pair of first outer walls and mating with the pair of mating depressions. Then, the pair of mating depressions and the pair of mating projections form the pair of first locking mechanisms.

For example, one of the mating depressions is provided so that a concave is formed in one of the first inner walls to have a horizontal cross-section shape resembling the letter "C" and a pair of the depressions are formed in the pair of first inner walls in directions opposite to each other. One of the mating projections is formed on one of the first outer walls to have a shape of approximately right triangle and to have inclined faces having a horizontal cross section with an acute angle, thereby providing a pair of projection ends on the pair of first outer walls in directions opposite to each other.

It could be concluded that providing the pair of mating depressions in the pair of inner walls of the base housing facilitates thinning of the pair of sidewalls defining the recess and insertion/removal of the socket connector. Further, it could be concluded that providing the pair of mating depressions in the pair of first inner walls of the base housing enables compaction of the base housing (reduction in mounting area).

(3) The electrical connector according to the invention (1) or (2) comprises: one or more grooves provided in the second inner wall that are formed in the recess and pass through along insertion and removal directions perpendicular to the attachment face of the print board; and a projection strip provided on the second outer wall and inserted into the groove, in which a first projection provided in the groove and a second projection provided on the projection strip and latched into engagement with the first projection form the second locking mechanisms.

For example, the groove is a square groove and the first projection is provided on one of the opposing inner walls of that square groove. Further, the projection strip is inserted into the square groove and the second projection on the projection strip passes over the first projection. In a situation where the socket contact is completely inserted into the recess, the second projection is latched into engagement with the first projection in order to allow mating engagement, i.e., locking engagement, between the socket connector and the base connector. Incidentally, in a case where the first projection is provided on the bottom face of the square groove, a force acts in a direction in which the socket connector is separated from the recess and thus, such configuration is not preferable. Further, the groove could have a round shape resembling the letter "U".

(4) The electrical connector according to any one of the inventions (1) to (3) is configured so that in response to increase in the number of the opponent contacts arranged in the base connector, the number of the second locking mechanisms is increased.

The subject of the invention is to provide an electrical connector capable of eliminating a force that causes the movement of the socket connector and that is considered substantially proportional to the number of arrangements of the opponent contacts and the number of the lead wires corresponding to the number of arrangements. For example, in case of two-pole connector, the number of grooves is "1" and in case of three-pole connector, the number of grooves is "2". Accordingly, if a designer is able to know the number of grooves per pole of the electrical connector by simply counting the number of opponent contacts, the designer can conveniently design a series of multi-pole connectors based on the inventive electrical connector.

(5) The electrical connector according to any one of the inventions (3) and (4) is configured so that the grooves are provided between the arrangements of the opponent contacts.

The opponent contacts are a metallic plate that is, for example, pressed into and fixed to the sidewall of the base housing. Further, it could be thought that the grooves are formed between the arrangements of the opponent contacts and therefore the rigid opponent contacts serve to prevent deformation of the walls forming the groove and interposed between poles.

The electrical connector of the invention is configured so that a pair of first locking mechanisms are installed in opposing walls forming a recess of a base connector and a pair of outer walls of a socket connector facing the opposing walls and further a second locking mechanism is installed in an inner wall forming a depression opposite the direction of extension of lead wires and an outer wall of the socket connector facing the inner wall, thereby preventing movement of the socket contact having a lower height about a point of support, which movement is due to the movement of lead wires, associated with a pair of locking mechanisms, and observed in the conventional electrical connector. Accordingly, the electrical connector provided described above allows secure engagement between the socket connector and the base connector without being affected by lead wires extending from the socket connector.

DETAILED DESCRIPTION OF THE PREFERRED EMBODIMENTS

Preferred embodiments of the invention will be explained below with reference to the accompanying drawings.

Figure 1:
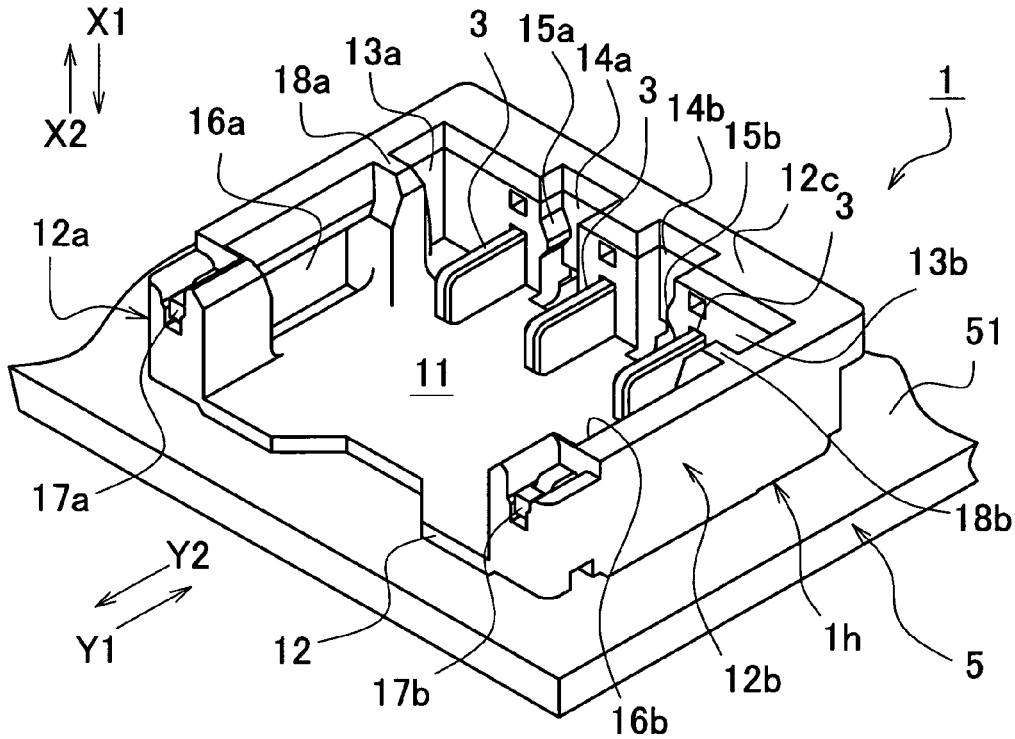
FIG. 1 is a perspective outline view of a base connector according to a first embodiment of the invention.
Figure 2:
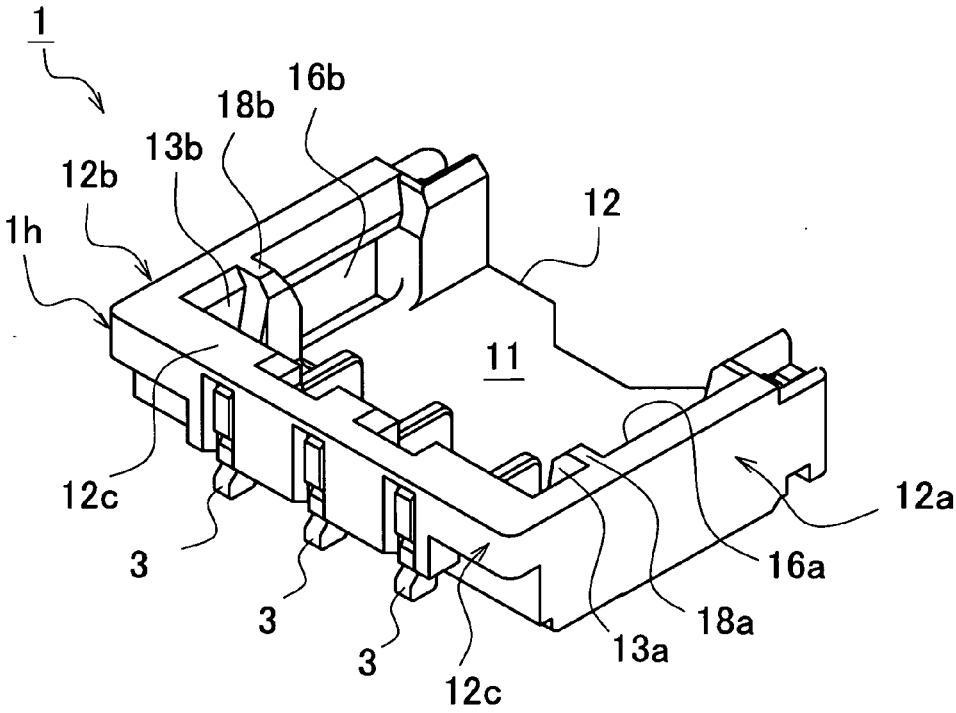
FIG. 2 is a perspective outline view of the base connector according to the first embodiment.
Figure 3:
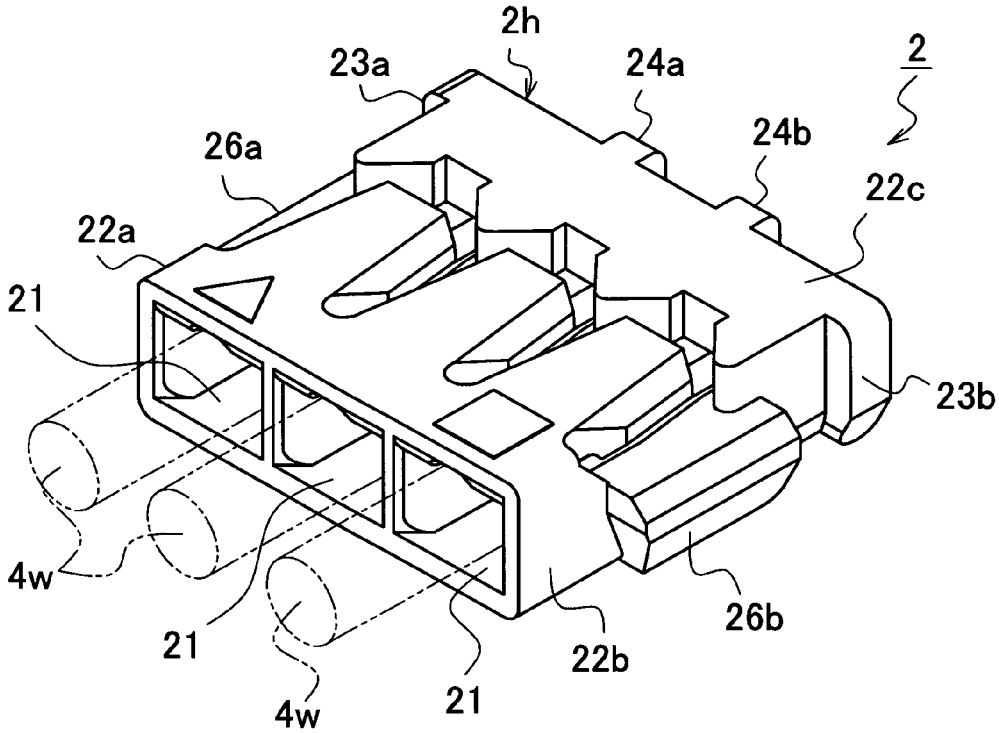
FIG. 3 is a perspective outline view of a socket connector according to the first embodiment.
Figure 4:
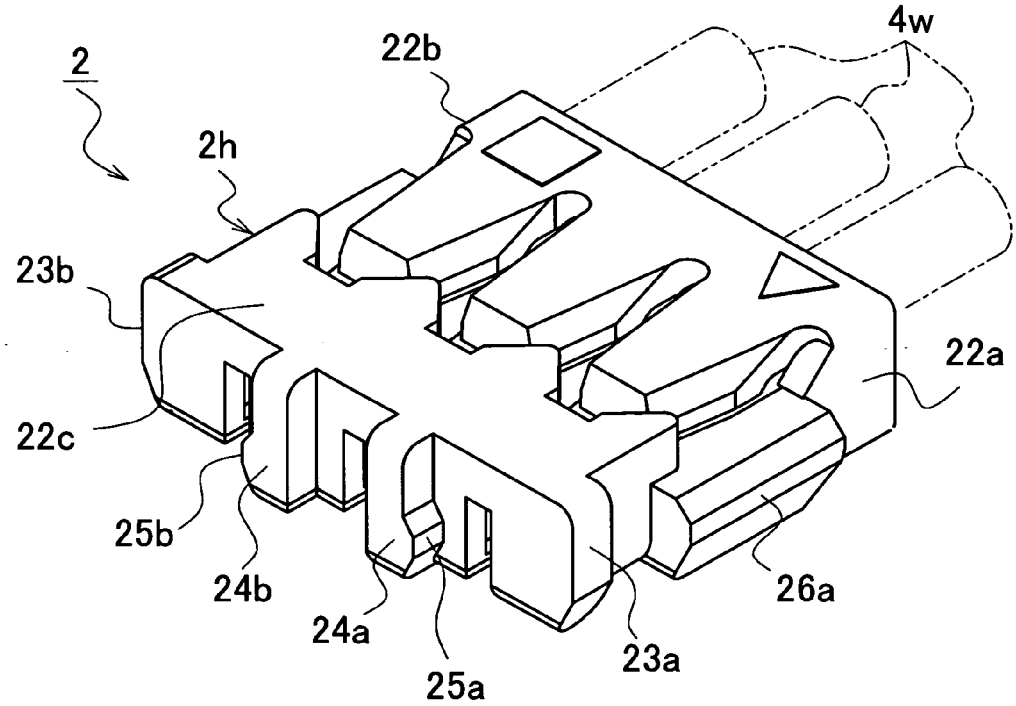
FIG. 4 is a perspective outline view of the socket connector according to the first embodiment.

FIG. 1 is a perspective outline view of a base connector according to a first embodiment of the invention. FIG. 2 is a perspective outline view of the base connector according to said first embodiment. FIG. 2 shows the base connector viewed from the side opposite that illustrated in FIG. 1. FIG. 3 is a perspective outline view of a socket connector according to said first embodiment. FIG. 4 is a perspective outline view of the socket connector according to said first embodiment. FIG. 4 shows the socket connector viewed from the side opposite that illustrated in FIG. 3.

Figure 5D:
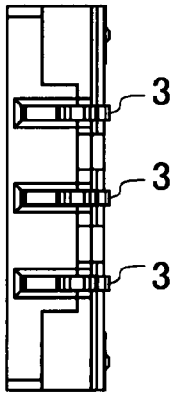
FIGS. 5A to 5F illustrate outlines and cross-sectional views of the base connector according to the first embodiment.
Figure 5F:
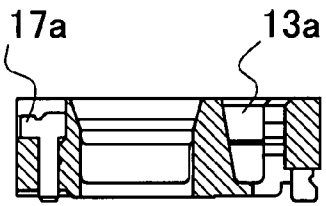
Figure 5A:
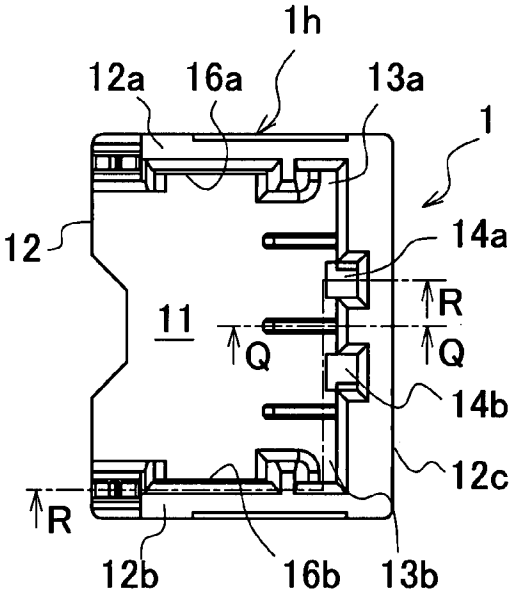
Figure 5B:
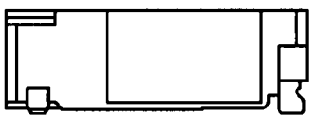
Figure 5C:
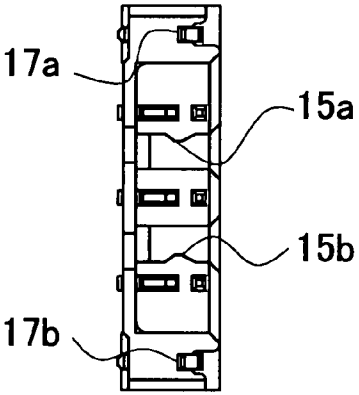
Figure 5E:
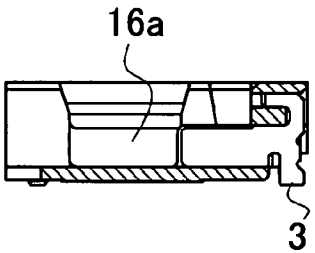
Figure 6C:
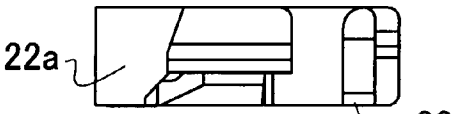
FIGS. 6A to 6E are outline views of the socket connector according to the first embodiment.
Figure 6A:
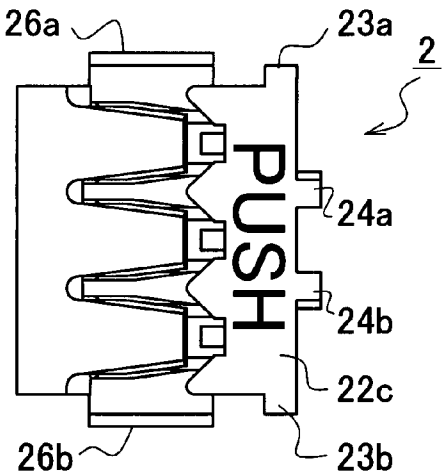
Figure 6B:
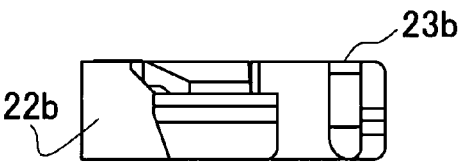
Figure 6D:
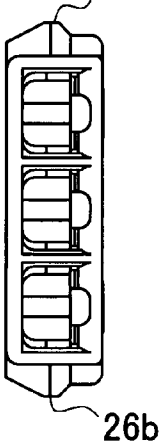
Figure 6E:
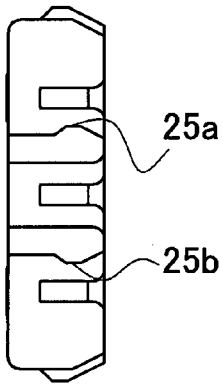

FIGS. 5A to 5F illustrate outlines and cross-sectional views of the base connector according to said first embodiment. FIG. 5A is a plan view of the base connector, FIG. 5B is a front view of the base connector, FIG. 5C is a left side view of FIG. 5A, FIG. 5D is a right side view of FIG. 5A, FIG. 5E is a cross sectional view taken along line Q—Q of FIG. 5A, and FIG. 5F is a cross sectional view taken along line R—R of FIG. 5A. FIGS. 6A to 6E are outline views of the socket connector according to said first embodiment. FIG. 6A is a plan view of the socket connector, FIG. 6B is a front view of the socket connector, FIG. 6C is a rear side view of the socket connector, FIG. 6D is a left side view of FIG. 6A, and FIG. 6E is a right side view of FIG. 6A.

Figure 7:
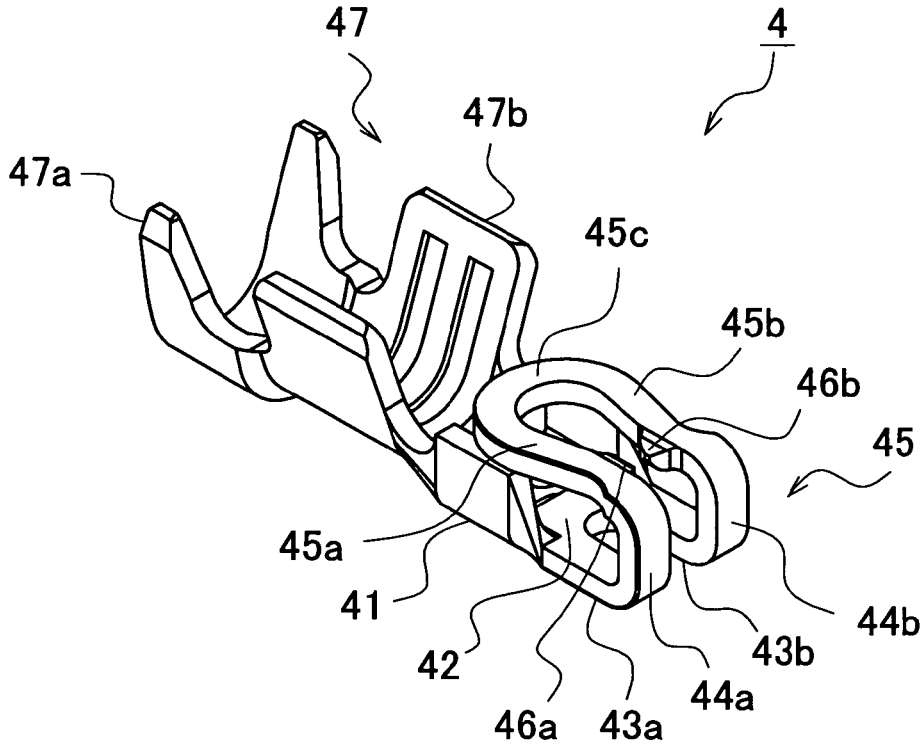
FIG. 7 is perspective outline view of a socket contact in the socket connector according to the first and second embodiments.
Figure 8:
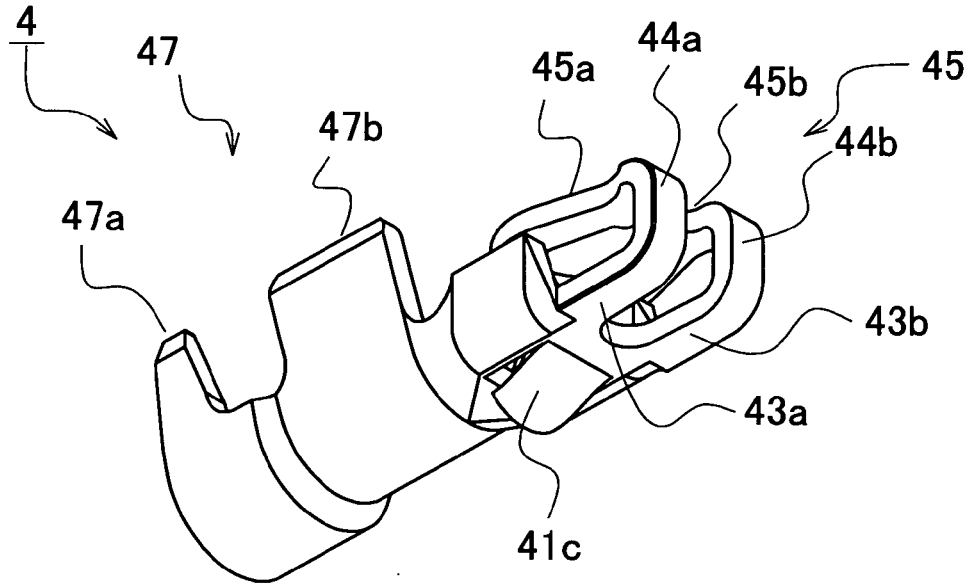
FIG. 8 is perspective outline view of the socket contact in the socket connector according to the first and second embodiments.
Figure 9:
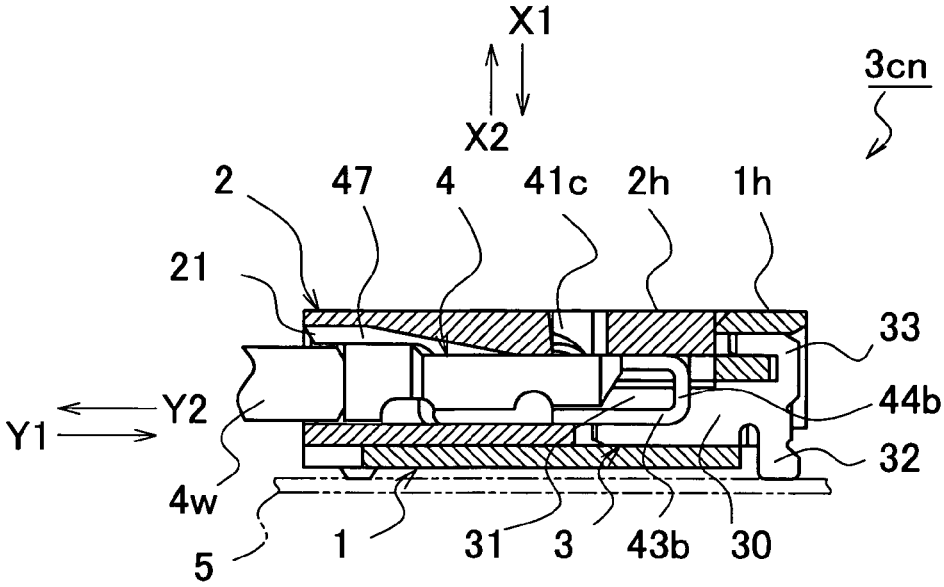
FIG. 9 is a vertical cross-sectional view of both connectors in a mated condition according to the first embodiment.
Figure 10:
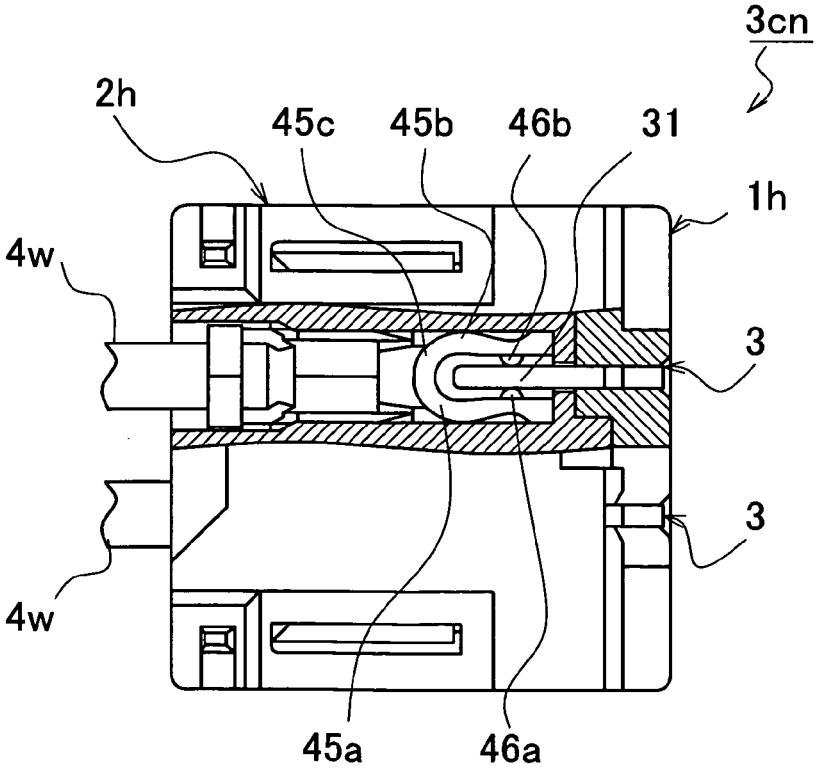
FIG. 10 is a plan view of both connectors in a mated condition according to the second embodiment and shows a horizontal cross-sectional view of a primary part of both connectors.

FIG. 7 is a perspective outline view of a socket contact used in the socket connector according to said first embodiment and a second embodiment. FIG. 8 is a perspective outline view of the socket contact used in the socket connector according to said first and second embodiments. FIG. 8 shows the socket contact viewed from the side opposite that illustrated in FIG. 7. FIG. 9 is a vertical cross-sectional view of both connectors in a mated condition according to said first embodiment. FIG. 10 is a plan view of both connectors in a mated condition according to said second embodiment. FIG. 10 shows a horizontal cross-sectional view of a primary part of both connectors.

Figure 11:
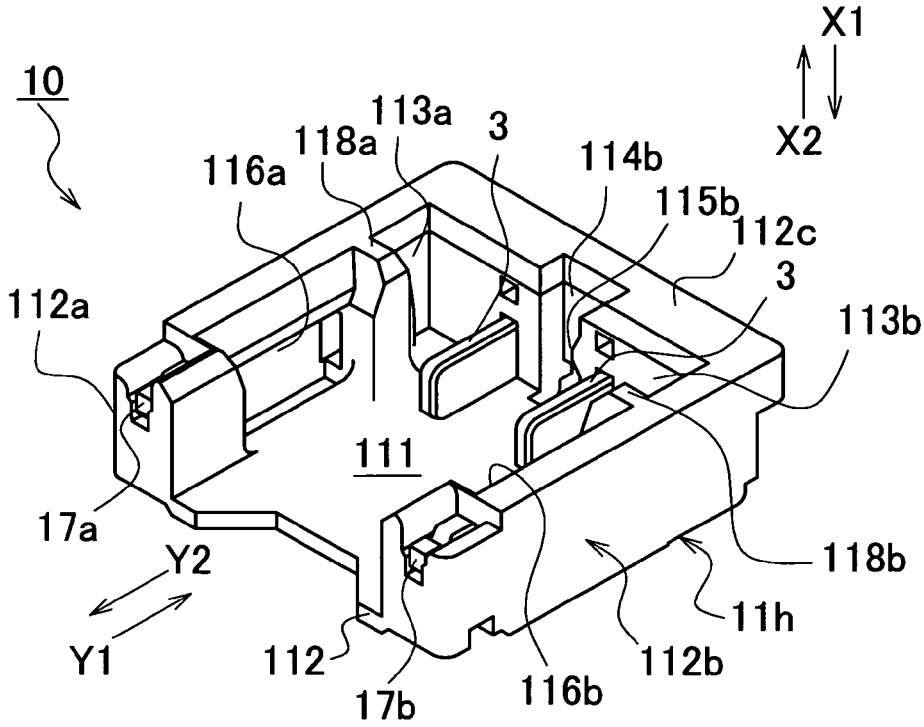
FIG. 11 is a perspective outline view of a base connector according to a second embodiment of the invention.
Figure 12:
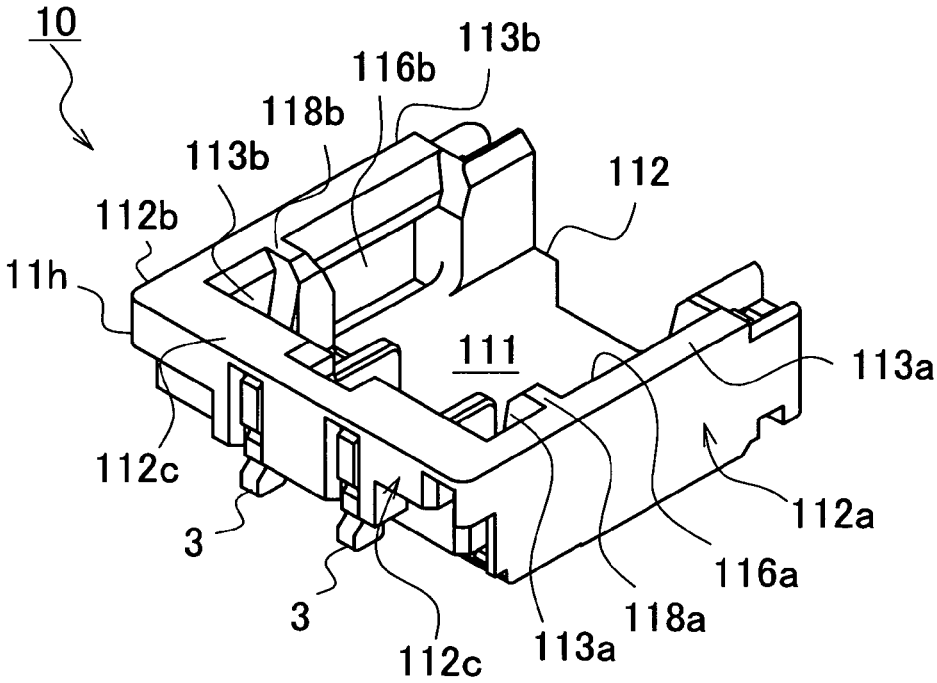
FIG. 12 is a perspective outline view of the base connector according to the second embodiment.
Figure 13:
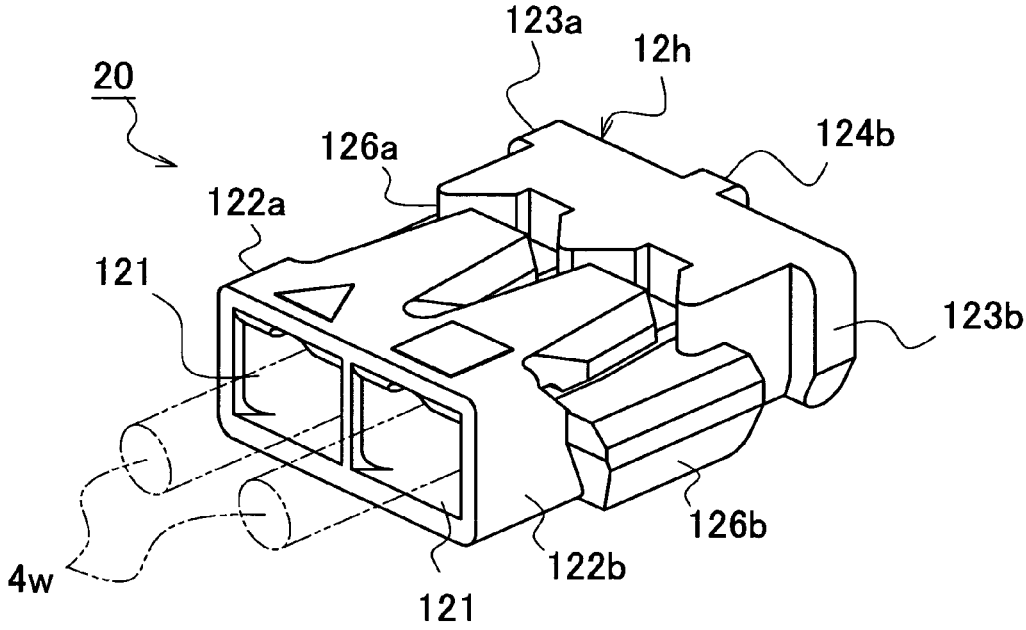
FIG. 13 is a perspective outline view of a socket connector according to the second embodiment.
Figure 14:
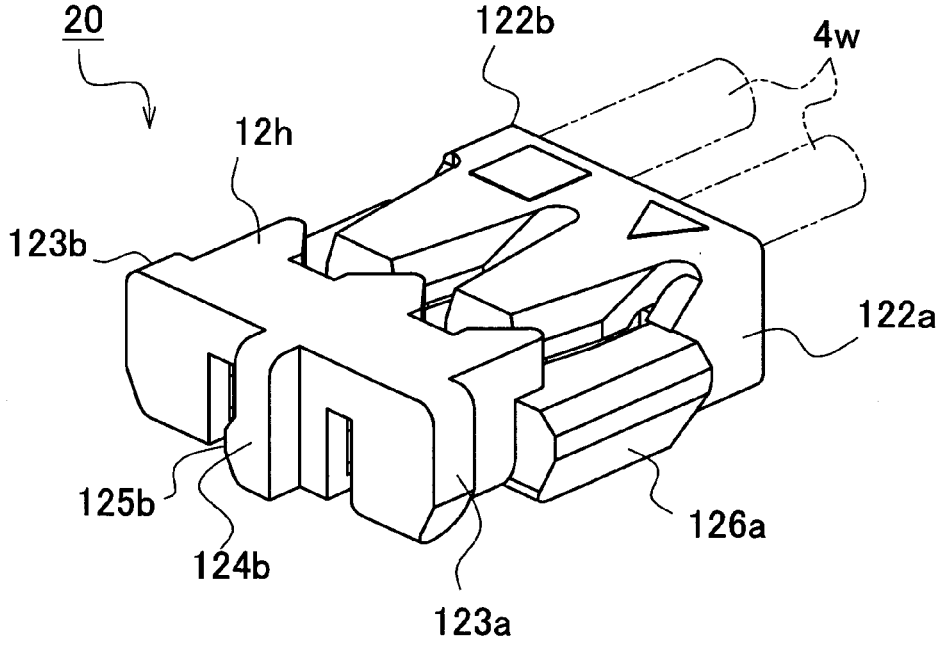
FIG. 14 is a perspective outline view of the socket connector according to the second embodiment.

FIG. 11 is a perspective outline view of the base connector according to the second embodiment of the invention. FIG. 12 is a perspective outline view of a base connector according to said second embodiment. FIG. 12 shows the base connector viewed from the side opposite that illustrated in FIG. 11. FIG. 13 is a perspective outline view of a socket connector according to said second embodiment. FIG. 14 is a perspective outline view of the socket connector according to said second embodiment. FIG. 14 shows the socket connector viewed from the side opposite that illustrated in FIG. 13.

Figure 15:
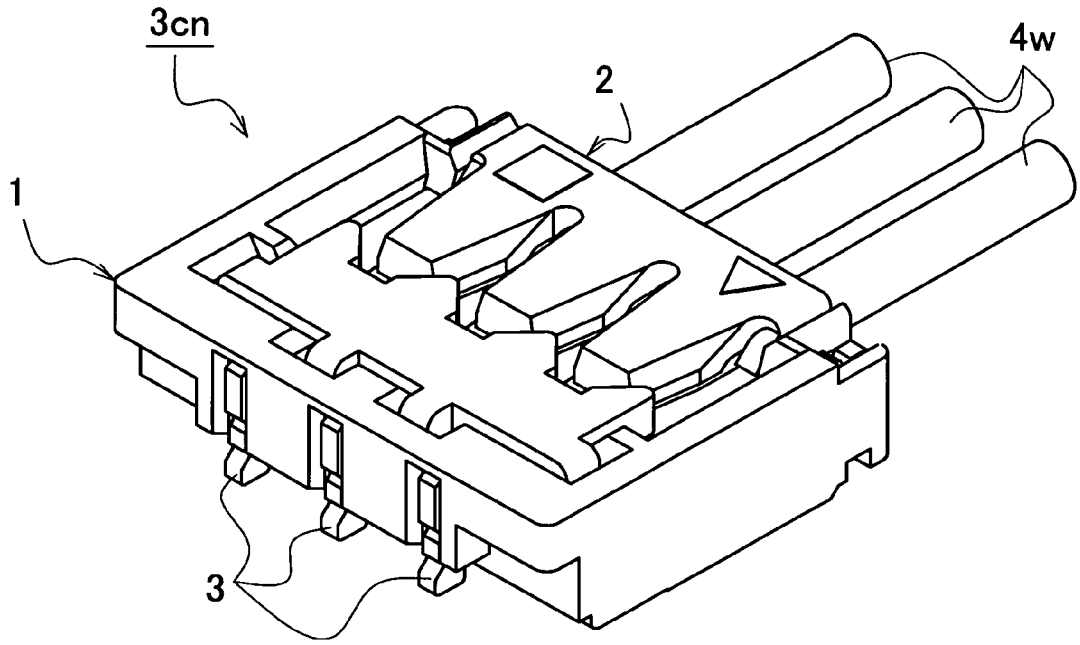
FIG. 15 is a perspective outline view of both connectors in a mated condition according to the first embodiment.
Figure 16:
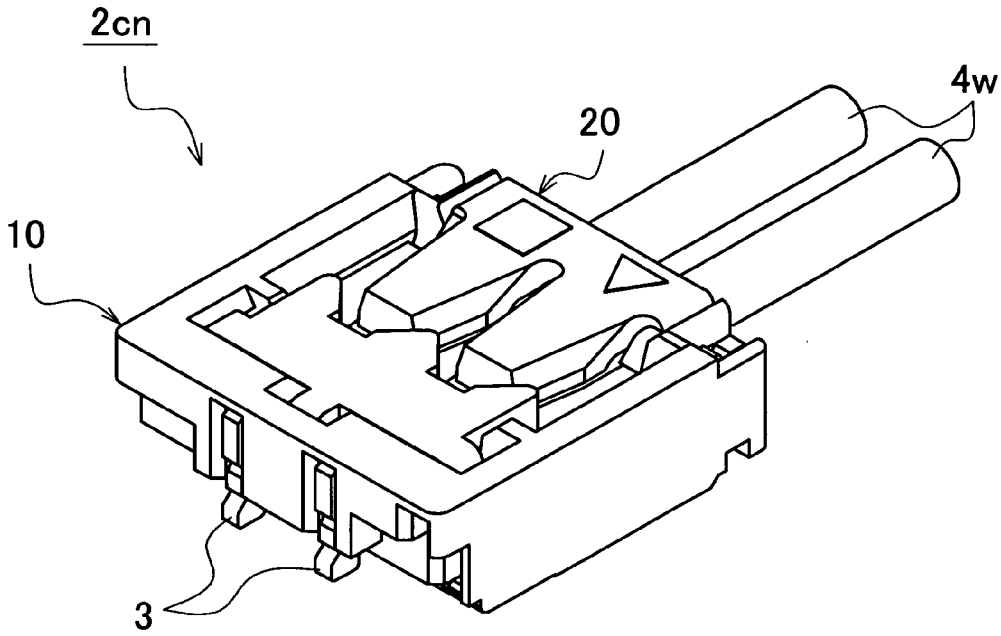
FIG. 16 is a perspective outline view of both connectors in a mated condition according to the second embodiment.
Figure 17:
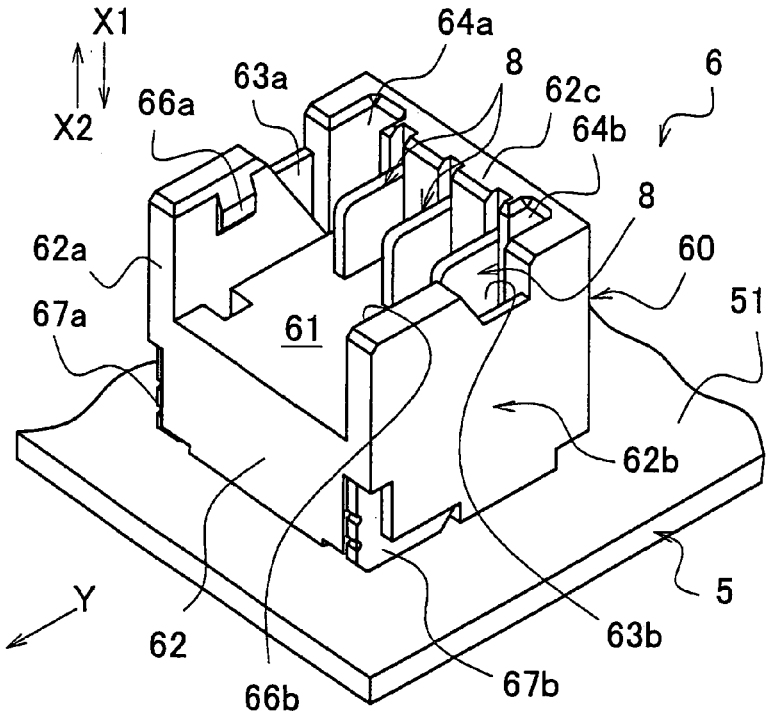
Fig. 17 PRIOR ART
FIG. 17 is a general perspective view of a base connector according to the prior art.
Figure 18:
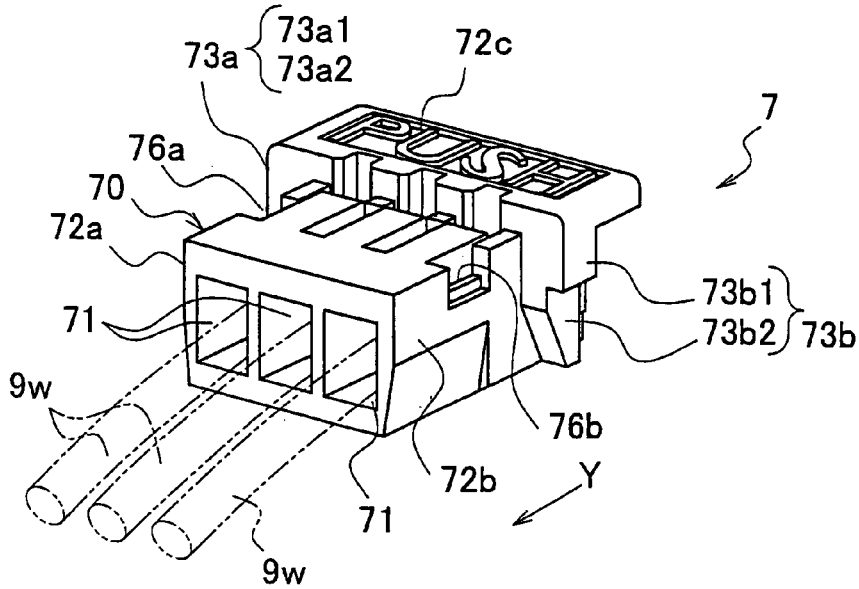
Fig. 18 PRIOR ART
FIG. 18 is a general perspective view of a socket connector according to the prior art.
Figure 19:
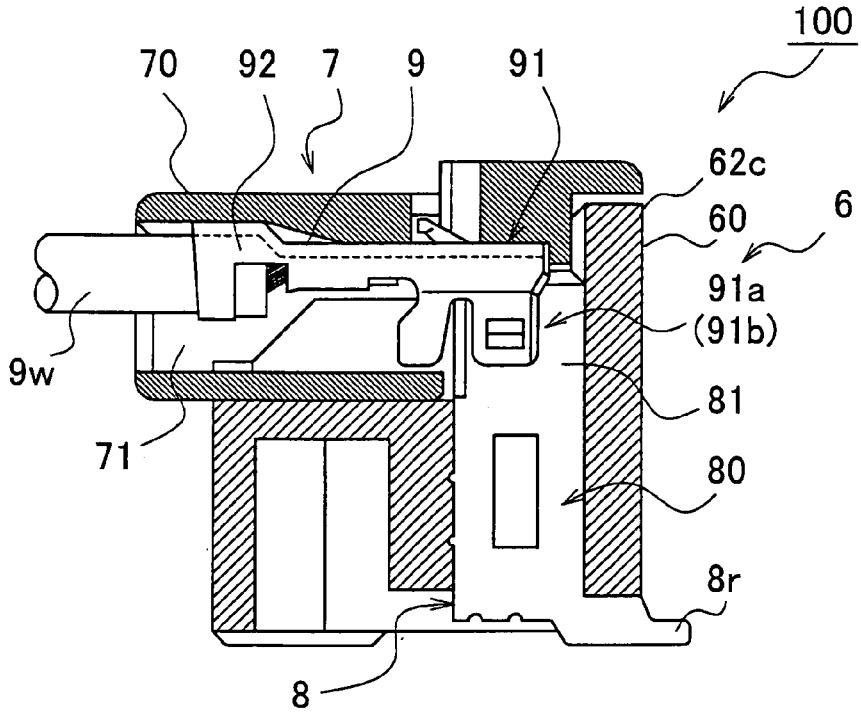
Fig. 19 PRIOR ART
FIG. 19 is a vertical cross-sectional view of both connectors in a mated condition according to the prior art.
Figure 20:
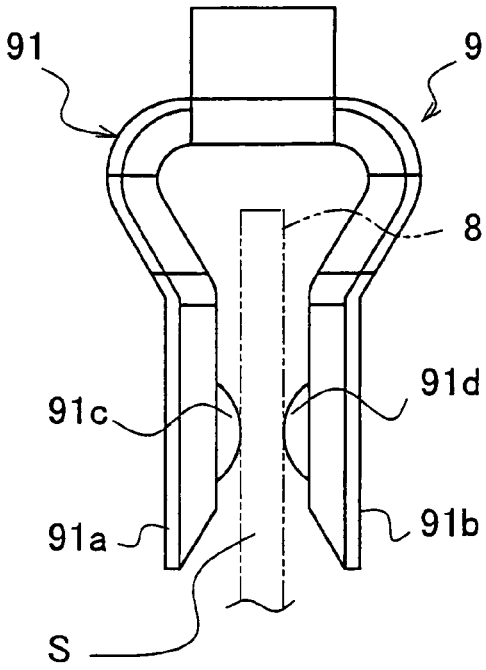
Fig. 20 PRIOR ART
FIG. 20 is a front view of the socket connector according to the prior art.

FIG. 15 is a perspective outline view of both connectors in a mated condition according to said first embodiment. FIG. 16 is a perspective outline view of both connectors in a mated condition according to said second embodiment.

First, the base connector and the socket connector according to the first embodiment of the invention will be explained. In FIG. 1 and FIG. 2, an approximately rectangular parallelepiped shaped base connector 1 is solder-bonded to an attachment face 51 of a print board 5. A recess 11 of the base connector 1 is open in a direction perpendicular to and away from the attachment face 51 of the print board 5 (i.e., corresponding to a removal direction X2 of FIG. 1), and is also open in one out of two opposite directions parallel to the attachment face 51, i.e., in a front direction Y2.

The socket connector shown in FIG. 3 and FIG. 4 is inserted into and removed from the recess 11 of the base connector 1 in an insertion direction X1 and a removal direction X2 perpendicular to the attachment face 51. The socket connector 2 includes a plurality of lead wires 4*w* extending generally in the front direction Y2.

When the socket connector 2 is removed from the base connector 1, the lead wires 4*w* are in some cases pulled in a direction other than the removal direction X2. If the wires are pulled in that direction, a pulling force via the lead wires 4*w* is converted to a force in the removal direction X2 of the socket connector 2 in order to smoothly remove the socket connector 2 without having to pry off the connectors.

In FIG. 1 and FIG. 2, the base connector 1 comprises a base housing 1*h* and the base housing 1*h* comprises a base 12 fixed along the attachment face 51, a pair of sidewalls 62*a*, 62*b* disposed in upright position on left/right sides of the base 12, and a sidewall 12*c* perpendicular to the sidewalls 12*a*, 12*b*. The base 12, the pair of sidewalls 12*a*, 12*b*, and the sidewall 12*c* together define the recess 11.

In FIG. 1 and FIG. 2, the recess 11 accommodates three plane contacts 3 that are arranged parallel to the pair of sidewalls 12*a*, 12*b*. In FIG. 5, the contacts 3 are held by the base 12 and the sidewall 12*c* in such a manner that press fitting strips 33 (refer to FIG. 9) of the contacts 3 are inserted into fixing holes provided in the sidewall 12*c*. As shown in FIG. 9, the contact 3 includes a substantially rectangular main body 30 and a lead portion 32 extending from the bottom to the rear of the main body 30. The main body 30 has a contact portion 31 protruding into the recess 11.

When both connectors 1, 2 are in a mated condition as shown in FIG. 9, a pair of inversion arms 45*a*, 45*b* of the socket contact 4 serve to sandwich the contact 3 from both sides of the contact in order to apply a contact force to the contact (refer to FIG. 10).

In FIG. 1 and FIG. 2, a pair of mating grooves 13*a*, 13*b* extending from the bottom of the recess 11 in the removal direction X2 are provided in the inner faces of the pair of sidewalls 12*a*, 12*b*. The pair of mating grooves 13*a*, 13*b* mate with a pair of convex strips 23*a*, 23*b* formed on and protruding from both sides of the socket connector 2 (refer to FIG. 3 and FIG. 4).

As shown in FIG. 3, FIG. 4 and FIG. 6, the pair of convex strips 23*a*, 23*b* each have a lower corner portion of an arc shape and arc faces of the corner portions form cam faces for slidable engagement with inclined faces (refer to FIG. 5) formed in the pair of mating grooves 13*a*, 13*b*.

In FIG. 1 and FIG. 2, a pair of mating depressions 16*a*, 16*b* facing each other are provided in a pair of first inner walls of the opposing sidewalls 12*a*, 12*b* in the recess 11. On the other hand, a pair of mating projections 26*a*, 26*b* are provided on a pair of first outer walls formed in opposite ends of the socket housing 2*h* (refer to FIG. 3, FIG. 4 and FIG. 6).

Further, the pair of mating projections 26*a*, 26*b* mate with the pair of mating depressions 16*a*, 16*b*, so that both connectors in a mated condition are held together with a predetermined amount of clamping force. In this manner, the pair of mating depressions 16*a*, 16*b* and the pair of mating projections 26*a*, 26*b* form a pair of first locking mechanisms for effecting engagement between the connectors, one of which is displaceable from the other in a direction perpendicular to the direction of extension of the lead wires 4*w*.

In FIG. 1 and FIG. 2, the pair of mating depressions 16*a*, 16*b* are formed in the pair of first inner walls to have a horizontal cross-section shape resembling the letter "C". A pair of the depressions are formed in the pair of first inner walls in directions opposite to each other. On the other hand, as shown in FIG. 3, FIG. 4 and FIG. 6, the pair of mating projections 26*a*, 26*b* are formed on one of the first outer walls to have a shape of approximately right triangle and to have inclined faces having a horizontal cross section with an acute angle, thereby providing a pair of projection ends on the pair of first outer walls in directions opposite to each other.

It could be concluded that providing the pair of mating depressions 16*a*, 16*b* in the pair of first inner walls of the base housing 1h enables thinning of the pair of sidewalls 12*a*, 12*b* defining the recess 11 and facilitates insertion/removal of the socket connector 2. Further, it could be concluded that providing the pair of mating depressions 16*a*, 16*b* in the pair of first inner walls of the base housing 1*h* enables compaction of the base housing 1*h* (reduction of mounting area).

Further, as shown in FIG. 1 and FIG. 2, in the recess 11 of the base housing 1*h*, two grooves 14*a*, 14*b* are provided in a second inner wall (of the sidewall 12*c*) formed in a position along a direction Y1 opposite the direction of extension of the lead wires 4*w*. The two grooves 14*a*, 14*b* are open toward the recess 11 and pass through along insertion/removal directions X1, X2 perpendicular to the attachment face 51 of the print board 5. Further, the two grooves 14*a*, 14*b* each are provided between the arrangements of the contacts 3. Moreover, first projections 15*a*, 15*b* each are formed on one of opposing inner walls of each of the two grooves 14*a*, 14*b* (refer to FIG. 1 and FIG. 5).

On the other hand, as shown in FIG. 3 and FIG. 4, in the socket housing 2*h*, two projection strips 24*a*, 24*b* are provided on a second outer wall formed in the direction Y1 (refer to FIG. 1) opposite the direction of extension of the lead wires 4*w*. Further, these projection strips 24*a*, 24*b* each are provided with second projections 25*a*, 25*b*, each of which is formed on one of the outer walls of each of the strips.

When the socket connector 2 is inserted into the recess 11, the two projection strips 24*a*, 24*b* are inserted into the two grooves 14*a*, 14*b* and the second projections 25*a*, 25*b* pass over the first projections 15*a*, 15*b*, respectively. In a situation where the socket contact 2 is completely inserted into the recess 11, the second projections 25*a*, 25*b* are latched into engagement with the first projections 15*a*, 15*b* in order to allow mating engagement between the socket connector 2 and the base connector 1 (refer to FIG. 15).

As described above, the two grooves 14*a*, 14*b* and the two projection strips 24*a*, 24*b* form one or more second locking mechanisms for effecting engagement between grooves and projection strips. Incidentally, the first projections 15*a*, 15*b* and the second projections 25*a*, 25*b* are also involved in the second locking mechanisms. Further, although the two grooves 14*a*, 14*b* are shown as a square groove, these grooves may be a circular groove having the shape of U letter.

In FIG. 1 and FIG. 2, a pair of projections 18*a*, 18*b* facing each other are provided in the recess 11. The one projection 18*a* separates the mating groove 13*a* and the mating depression 16*a*. Further, the one projection 18*a* is inserted between the convex strip 23*a* and the mating projection 26*a*. The other projection 18*b* separates the mating groove 13*b* and the mating depression 16*b*. Further, the other projection 18*b* is inserted between the convex strip 23*b* and the mating projection 26*b*.

In FIG. 1, FIG. 2 and FIG. 5, a pair of reinforcing tabs 17*a*, 17*b* as a metallic reinforcing member are pressed into press-fit grooves formed in the lower front portions of the base housing 1*h* and a part of the reinforcing tab is exposed from the corresponding bottom face of the base housing 1*h* so as to be solder-bonded to the attachment face 51 of the print board 5.

In FIG. 6, the socket connector 2 comprises in its front section projections 22*c* provided on the upper face, i.e., a pressing face of the socket housing 2*h* and protruding so as to correspond to the positions of the socket contacts 3, and the pair of convex strips 23*a*, 23*b* formed on and protruding from both side faces of the socket housing 2*h*, respectively. Pressing the surfaces of the projections 22*c* allows the socket connector 2 to be mounted onto the base connector 1.

In FIG. 3 and FIG. 4, the socket connector 2 includes the approximately rectangular parallelepiped shaped socket housing 2*h*. The socket housing 2*h* is provided with wire receiving holes 21 extending in the direction of extension of the lead wires 4*w*. The socket housing 2*h* includes a plurality of wire receiving holes 21 arranged in parallel fashion. The individual receiving holes 21 house the socket contacts 4 that are joined using mechanical press bonding to the ends of the lead wires 4*w* (refer to FIG. 9).

The socket contact 4 shown in FIG. 7 and FIG. 8 is connected to the plane contact 3. The socket contact 4 comprises an elongated press-bonding portion 47 to which the lead wire 4*w* is connected and a contact connection portion 45 provided in the proximal end of the press-bonding portion 47 and connected to the opponent contact 3.

The contact connection portion 45 comprises a plane contact main body 41, a pair of approximately parallel extension arms 43*a*, 43*b* extending from the proximal end of the contact main body 41, and a pair of approximately parallel inversion arms 45*a*, 45*b* extending from the tips of the pair of extension arms 43*a*, 43*b* to the contact main body 41 so as to be coupled together at their ends. Further, the pair of inversion arms 45*a*, 45*b* are provided with a pair of opposing contact points 46*a*, 46*b* defining a space into which the contact 3 can be inserted.

As shown in FIG. 7 and FIG. 8, the tips of the pair of inversion arms 45*a*, 45*b* are coupled together. The tips of the pair of inversion arms 45*a*, 45*b* are previously coupled together to form a combined portion 45*c* and the pair of inversion arms 45*a*, 45*b* are formed by bending processing.

As shown in FIG. 7 and FIG. 8, the pair of inversion arms 45*a*, 45*b* are provided with the pair of contact points 46*a*, 46*b* that are semi-spherical projections facing each other and formed on faces of the arms perpendicular to the thickness of the arm, which faces are closer to folding portions 44*a*, 44*b*. The pair of contact points 46*a*, 46*b* define a space into which the opponent plane contact 3 (refer to FIG. 9) can be inserted. The opponent contact 3 is inserted between the pair of contact points 46*a*, 46*b* in a direction from the pair of inversion arms 45*a*, 45*b* to the pair of extension arms 43*a*, 43*b* (refer to FIG. 9 and FIG. 10).

When the opponent contact 3 is inserted between the pair of contact points 46*a*, 46*b*, the pair of contact points 46*a*, 46*b* are pushed away from each other. That is, the pair of extension arms 43*a*, 43*b* and the pair of inversion arms 45*a*, 45*b* on the side of the folding portions 44*a*, 44*b* are pushed away from each other. Since the pair of extension arms 43*a*, 43*b* and the pair of inversion arms 45*a*, 45*b* on the opposite side to the folding portions 44*a*, 44*b* are coupled together, an elastic force is transformed to a contact force which in turn is successfully applied to both faces of the opponent contact 3.

The socket contact 4 allows a greater contact force to be applied on the opponent contact than the conventional socket contact does and further can become smaller in volume than the conventional socket contact. Moreover, the socket contacts 4 can be arranged in parallel with a pitch of as little as 1.2 mm. The socket contact 2 provided with such socket contacts 4 allows an electrical connector to be lower in height and smaller in volume.

In FIG. 7 and FIG. 8, the socket contact 4 is provided with a press-bonding portion 47 to which the lead wire 4 is joined using mechanical press bonding. Further, the pressing portion 47 comprises an insulation grip 47*a* joined using mechanical press bonding to a clad portion of the lead wire 4*w* and a conductor grip 47*b* joined using mechanical press bonding to a core wire of the lead wire 4*w*. One end of the lead wire 4*w* is joined using mechanical press bonding and inserted into the receiving hole 21 (refer to FIG. 9).

In FIG. 9, an elastic and projecting lance 41*c* is latched into engagement with an engagement hole, which is in communication with the receiving hole 21 and open to the outside, in order to prevent the socket contact 4 from falling out through the receiving hole 21. Openings are formed in portions of the socket connector 2 so as to allow the pair of contact points 46*a*, 46*b* to face the base connector 1 and therefore the contact 3 can be inserted between the pair of contact points 46*a*, 46*b* (refer to FIG. 10).

Next, a base connector and a socket connector according to a second embodiment of the invention will be explained. For comparison with the base connector 1 according to the first embodiment shown in FIG. 1 and FIG. 2, we present in FIG. 11 and FIG. 12 a base connector 10 according to the second embodiment. Further, for comparison with the socket connector 2 according to the first embodiment shown in FIG. 1 and FIG. 2, we present in FIG. 13 and FIG. 14 a socket connector 20 according to the second embodiment.

Then, the base connector 1 and the socket connector 2 shown in the first embodiment are combined to form a three-pole connector 3*cn* (refer to FIG. 15). On the contrary, the base connector 10 and the socket connector 20 shown in the second embodiment are combined to form a two-pole connector 2*cn* (refer to FIG. 16).

The three-pole connector 3*cn* and the two-pole connector 2*cn* have almost the same configuration and operation. Accordingly, only a difference between the second embodiment shown in FIG. 13 to FIG. 16 and the first embodiment will be explained and therefore the explanation relating to the first embodiment will be omitted.

It should be noted that individual signs used in FIG. 11 to FIG. 14 are such that a "1" is given to the left of each of the signs used in the first embodiment so as to allow the sign to start with "1", and elements and parts with these signs given by "1" designate the same elements and parts as those of the first embodiment. For example, "base housing 1*h*" is represented by "base housing 11*h*" and "recess 11" is represented by "recess 111". Elements common to the first and second embodiments are designated by the same sign.

Referring to FIG. 11 and FIG. 12, in the recess 111 of the base housing 11*h*, a groove 114*b* is provided in a second inner wall (of the sidewall 112*c*) formed in a position along a direction Y1 opposite the direction of extension of the lead wires 4*w*. The groove 114*b* is open toward the recess 111 and passes through along insertion/removal directions X1, X2 perpendicular to the attachment face 51 of the print board 5 (refer to FIG. 1). Further, the groove 114*b* is provided between the arrangements of the contacts 3. Moreover, a first projection 115*b* is provided on one of opposing inner walls of the groove 114*b* (refer to FIG. 11).

On the other hand, as shown in FIG. 13 and FIG. 14, in the socket housing 12*h*, a projection strip 124*b* is provided on a second outer wall formed in a position along a direction Y1 (refer to FIG. 1) opposite the direction of extension of the lead wires 4*w*. Further, the projection strip 124*b* is provided with a second projection 125*b* on one of the outer walls of the strip.

When the socket connector 20 is inserted into the recess 111, the projection strip 124*b* is inserted into the groove 114*b* and the second projection 125*b* passes over the first projection 115*b*. In a situation where the socket connector 20 is completely inserted into the recess 111, the second projection 125*b* is latched into engagement with the first projection 115*b* in order to allow mating engagement between the socket connector 20 and the base connector 10 (refer to FIG. 16). As described above, the groove 114*b* and the projection strip 124*b* form a second locking mechanism for effecting engagement between a projection strip and a groove.

Incidentally, it can be thought that a force causing the socket connector to move is generally in proportion to the number of arrangements of opponent contacts and the number of lead wires corresponding to the number of arrangements. For example, in case of two-pole connector 2*cn*, the number of grooves is "1" and in case of three-pole connector 3*cn*, the number of grooves is "2". Accordingly, if a designer is able to know the number of grooves per pole of the electrical connector by simply counting the number of opponent contacts, the designer can conveniently design a series of multi-pole connectors based on the inventive electrical connector.

The socket contact according to the invention is configured so that the pair of first locking mechanisms are installed at both sides of the socket housing and the second locking mechanism is installed in a position opposite the direction of extension of the lead wires, thereby preventing movement of the socket contact having a lower height about a point of support, which movement is due to the movement of lead wires, associated with a pair of locking mechanisms, and observed in the conventional electrical connector. Accordingly, the electrical connector described above allows secure engagement between the socket connector and the base connector without being affected by lead wires extending from the socket connector.

The socket connectors 2, 20 are significantly reduced in volume due to the structure of the socket contact 4. Further, although a pitch between the opponent contacts 3 is, for example, 1.2 mm, the structure of the socket contact 4 allows the combination of the socket connectors 2, 20 with the base connector. Further, the connectors 2*ch*, 3*ch* allow high density mounting of electrical connectors on a print board.

What is claimed is:

1. An electrical connector comprising:

a base connector having a base housing and fixed to a print board, the base housing defining a recess having a plurality of plane opponent contacts;

a socket connector having a socket housing that houses a plurality of socket contacts to be connected with the opponent contacts, the socket connector inserted into and removed from the recess;

a plurality of lead wires extending in a direction substantially parallel to an attachment face of the print board in a situation where the base connector is inserted into the socket connector;

a pair of first locking mechanisms provided with the base housing and the socket housing, respectively, the first locking mechanisms engaging each other in a direction perpendicular to the direction of extension of the lead wires; and one or more of second locking mechanisms provided with the base housing and the socket housing, respectively, the second locking mechanisms engaging each other in a direction opposite the direction of extension of the lead wires;

wherein the second locking mechanisms comprise:

the first projections provided on one of the opposing inner walls of each of the two grooves; and the second projections provided on one of the outer walls of each of the strips.

2. The electrical connector according to claim 1, wherein the first locking mechanisms comprise:

a pair of mating depressions provided in a pair of first inner walls of the base housing; and a pair of mating projections provided on a pair of first outer walls of the socket housing and mating with the pair of mating depressions.

3. The electrical connector according to claim 1, wherein the second locking mechanisms comprise:

one or more grooves provided in a second inner wall that are formed in the recess and pass through along insertion and removal directions perpendicular to the attachment face of the print board; and a projection strip provided on a second outer wall of the socket housing and inserted into the groove.

4. The electrical connector according to claim 1, wherein in response to increase in the number of the opponent contacts arranged in the base connector, the number of the second locking mechanisms is increased.

5. The electrical connector according to claim 3, wherein the grooves are provided between the arrangements of the opponent contacts.

* * * * *